US005465025A

United States Patent [19]

Hendrickson

[11] Patent Number: 5,465,025

[45] Date of Patent: Nov. 7, 1995

[54] LAMP WITH REMOVABLE BASE AND REPLACEABLE BULB CAPSULE

[75] Inventor: Thomas S. Hendrickson, Crestwood, Ill.

[73] Assignee: Litetronics International, Inc., Alsip, Ill.

[21] Appl. No.: 59,777

[22] Filed: May 10, 1993

[51] Int. Cl.[6] ..... H01J 5/54; H01R 33/00; F21V 17/00

[52] U.S. Cl. ..... 313/318.09; 313/50; 313/51; 313/318.10; 313/318.11; 313/318.12; 313/113; 362/226; 362/310; 362/368; 439/601; 439/616; 439/617

[58] Field of Search ..... 313/378, 50, 51, 313/113, 318.09, 318.10, 318.11, 318.12; 362/226, 310, 448, 455, 440, 441, 368; 439/602, 613, 615, 616, 617

[56] References Cited

U.S. PATENT DOCUMENTS

| | | | |
|---|---|---|---|
| 487,479 | 12/1892 | Frei | 362/226 |
| 3,356,984 | 12/1967 | Thorington et al. | 313/318 X |
| 4,679,126 | 7/1987 | Van Sickler | 362/226 |
| 4,785,218 | 11/1988 | Kohl et al. | 313/318 X |
| 4,816,977 | 3/1989 | Sorensen | 313/318 X |
| 4,886,994 | 12/1989 | Ragge, Jr. | 313/318 |
| 4,935,852 | 6/1990 | Hsu | 313/318 X |
| 4,956,756 | 9/1990 | Hsiao | 362/226 |
| 4,958,266 | 9/1990 | Sorensen et al. | 362/448 X |
| 4,991,071 | 2/1991 | Braasch | 362/249 |
| 5,001,615 | 3/1991 | Stefanelli | 362/226 |
| 5,021,706 | 6/1991 | Chen | 313/318 |
| 5,057,982 | 10/1991 | Hanami | 362/226 |
| 5,065,292 | 11/1991 | Aubrey | 362/226 X |
| 5,134,554 | 7/1992 | Donato et al. | 362/226 |
| 5,154,508 | 10/1992 | Ahroni | 313/51 X |

*Primary Examiner*—Sandra L. O'Shea
*Assistant Examiner*—Ashok Patel
*Attorney, Agent, or Firm*—Emrich & Dithmar

[57] ABSTRACT

A lamp has a globe with an open rear portion encircled by a mounting collar. A removable base structure includes a base member with a cylindrical wall telescopically receiving the mounting collar therein, with pins on the collar latching in J-shaped slots on the base. A ceramic socket is received in a cup-shaped socket holder having an annular flange fixed to the base member. The holder has an aperture through which a replaceable bulb capsule can be received so that its wire terminal leads can be plugged directly into the socket. A wave spring is retained on the holder flange for engagement with a flange on the mounting collar to bias the assembly in its latched condition, with the socket holder and the bulb capsule extending into the globe through the open end thereof.

20 Claims, 2 Drawing Sheets

12
20
21
22
23
25
26
30
31
32
33
34
35
36
37
37a
40
42
43
44
46
47
48
49
50
51
52
53
54
55
56
57
59
60
61
62
65

LAMP WITH REMOVABLE BASE AND REPLACEABLE BULB CAPSULE

BACKGROUND OF THE INVENTION

1. Field of the Invention

The present invention relates to lamps and, in particular, to lamps of the type with replaceable bulb capsules.

2. Description of the Prior Art

This invention is an improvement of the lamp disclosed in U.S. Pat. No. 4,816,977. That lamp has a globe with a cylindrical metal mounting shell fixed to its open end. A removable base structure includes a ceramic socket with holes containing spring contacts which respectively receive the contact pins of a replaceable bulb capsule having a ceramic base. The removable base structure, with the bulb capsule mounted thereon, is then insertable through the open end of the globe. Tabs on the mounting shell slide in grooves on the socket wall to align the parts. Leaf springs projecting laterally from the socket engage a radially extending annular flange on the mounting shell to latch the parts together. The base structure includes a separate threaded cap which fits over one end of the socket and is fixed thereto.

In order to remove the removable base structure from the globe for the purpose of replacing the bulb capsule, it is necessary to simultaneously grasp and compress the leaf springs, which is sometimes difficult to do. Furthermore, the spring contacts, which are subjected to considerable heat, tend to fail over time. Also, the ceramic socket is exposed and may be subject to cracking or the like if it strikes surrounding objects. Finally, the bulb capsule with the ceramic base is relatively expensive.

SUMMARY OF THE INVENTION

It is a general object of the invention to provide an improved lamp which avoids the disadvantages of prior lamp constructions, while affording additional structural and operating advantages.

An important feature of the invention is the provision of a lamp with a globe and a removable base structure which is easy to mount and demount relative to the globe.

Another feature of the invention is the provision of a lamp of the type set forth, which includes a ceramic socket protected in use and characterized by long life.

Yet another feature of the invention is the provision of a lamp of the type set forth which is usable with replaceable bulb capsules which do not have ceramic bases.

Still another feature of the invention is the provision of a lamp of the type set forth which is of relatively simple and economical construction.

These and other features of the invention are attained by providing a lamp for use with a replaceable bulb capsule, comprising: a globe having a light transmitting front portion and a rear portion defining an opening thereinto, first mounting means on the rear portion including a hole aligned with the opening, and removable base structure including a socket constructed to removably receive an associated replaceable bulb capsule, the base structure including second mounting means telescopically receiving the rear portion therein for engagement with the first mounting means in a mounted condition in which the socket and the associated replaceable bulb capsule received therein extend through the opening and the hole into the globe.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 3, 4, 5, 6:
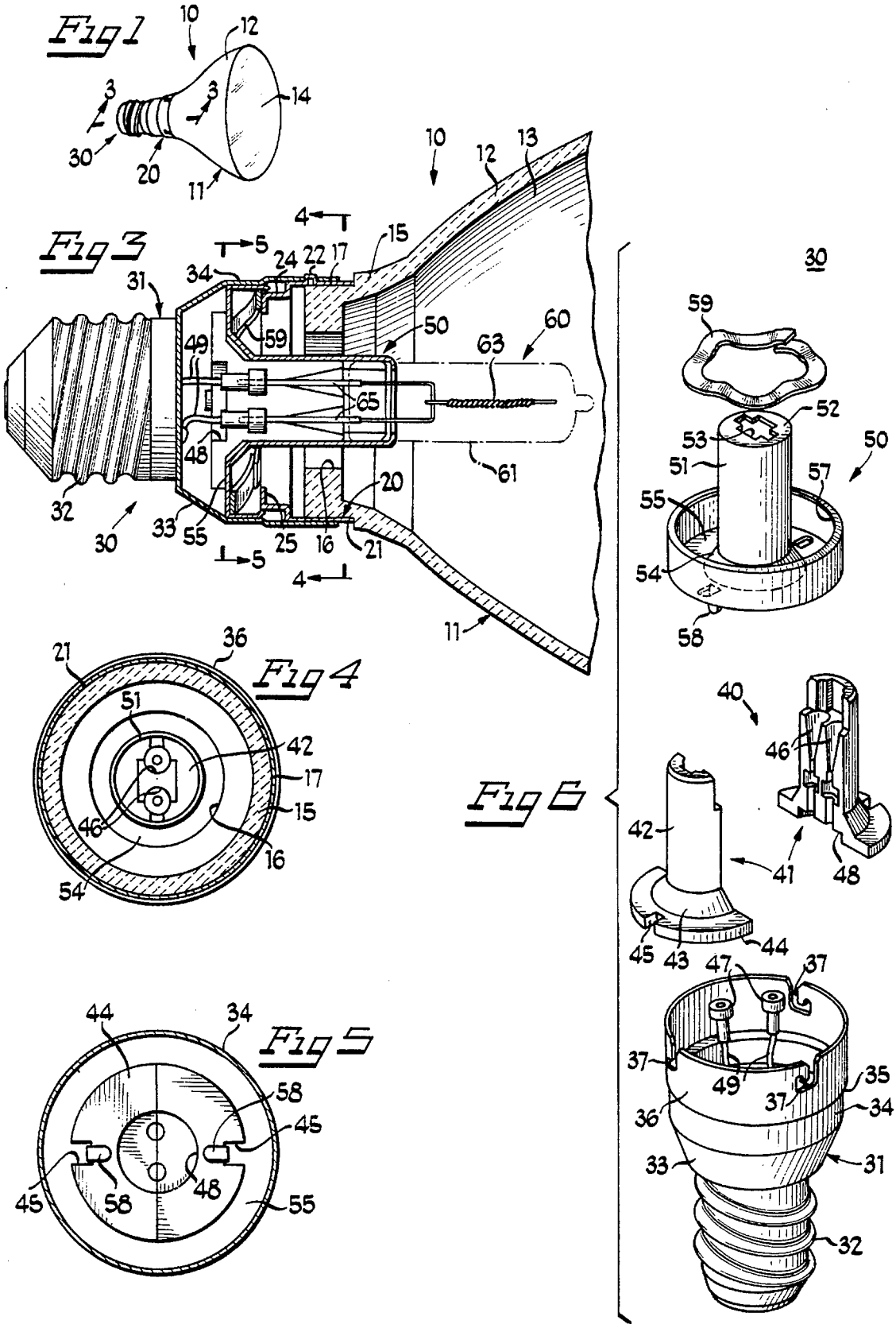
FIG. 1 is a perspective view of a lamp in accordance with the present invention.
FIG. 3 is an enlarged, fragmentary view in partial vertical section, taken generally along the line 3—3 in FIG. 1.
FIG. 4 is a sectional view taken along the line 4—4 in FIG. 3.
FIG. 5 is a sectional view taken along the line 5—5 in FIG. 3.
FIG. 6 is a reduced, exploded, perspective view of the removable base structure of FIG. 2.
Figures 2, 7:
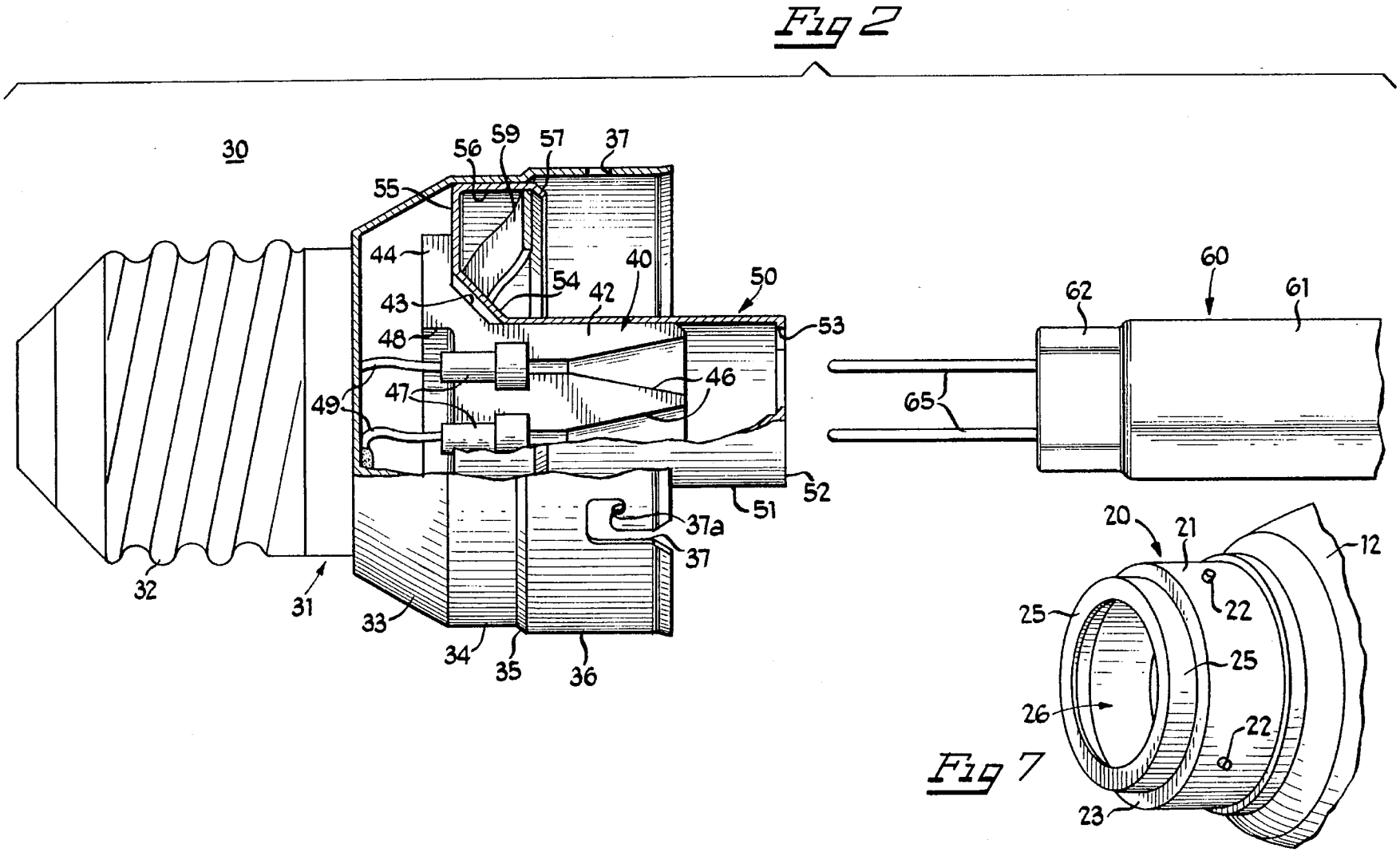
FIG. 2 is an enlarged side elevational view, in partial section, of the removable base structure of the lamp of FIG. 1, illustrating the replaceable bulb capsule disposed for insertion therein.
FIG. 7 is an enlarged, fragmentary, perspective view of the rear end portion of the globe of the lamp of FIG. 1.

Referring to FIGS. 1–3, there is illustrated a lamp 10 constructed in accordance with and embodying the features of the present invention. The lamp 10 includes a globe 11, a removable base structure in the form of a base assembly 30 and a replaceable bulb capsule 60. The globe 11 may be formed of glass, and has a generally frustoconical side wall 12, which may be provided with a reflector material 13 along the inner surface thereof, and is closed at the large end thereof by a light-transmitting end wall 14. The globe 11 has a rear end portion 15, which defines a circular opening 16 and is provided with a cylindrical outer surface 17. While the globe 11 is illustrated as being of the frustoconical type used for display lamps, such as spotlights, floodlights, and the like, it will be appreciated that the globe 11 could have any desired shape for different types of lamp applications. The globe 11 may be formed of clear or frosted glass, depending upon the application. While glass has been described in the preferred embodiment, other materials, such as plastic or the like could be used.

Referring also to FIG. 7, a mounting collar 20 is fixed to the rear end portion 15 of the globe 11. In particular, the mounting collar 20 has a cylindrical side wall 21 dimensioned to telescopically receive therein and firmly engage the cylindrical surface 17 of the globe 11, being affixed thereto by suitable means. The cylindrical wall 21 has three equiangularly spaced-apart pins 22 projecting radially outwardly therefrom. The wall 21 is integral at its rear end with a radially inwardly extending annular shoulder 23 which is, in turn, integral at its inner end with a rearwardly extending cylindrical wall portion 24. The wall portion 24 is, in turn, integral at its rear end with a radially inwardly extending annular flange 25 which defines a hole 26 (FIG. 7) somewhat larger in diameter than the opening 16 in the globe 11 and coaxial therewith.

Referring also to FIGS. 4–6, the base assembly 30 includes a generally cylindrical base member 31 having a cup-shaped threaded end portion 32 adapted to be threadedly engaged in an associated lamp receptacle for electrical connection thereto in a known manner. While a threaded coupling is illustrated, it will be appreciated that the base assembly 30 could be provided with other types of known couplings to an associated lamp receptacle. The threaded end portion 32 is integral at its open end with a radially outwardly flared frustoconical shoulder 33, the wide end of which is, in turn, integral with a cylindrical wall portion 34. The wall portion 34, in turn, is integral with a short radially outwardly flared frustoconical shoulder 35, which terminates in a cylindrical wall portion 36 provided in its distal end edge with three equiangularly spaced-apart J-shaped slots 37. The cylindrical wall portion 36 is dimensioned to telescopically receive therein, in close-fitting relationship, the cylindrical wall 21 of the mounting collar 20 on the globe 11, with the pins 22 respectively adapted to be received in the J-shaped slots 37. It will be appreciated that, when the pins 22 reach the ends of the J-shaped slots 37, the base member 31 may be rotated about its axis a slight distance to bring the pins 22 into alignment with the hook end portions 37*a* (see FIG. 2) of the slots 37. Thus, the pins 22 and the slots 37 cooperate to form a latching mechanism for latching the base member 31 into engagement with the mounting collar 20, in a known manner.

The base assembly 30 further includes a socket 40, which comprises a split ceramic body 41 having a cylindrical portion 42 integral at one end thereof with a radially outwardly flared frustoconical shoulder 43, which is, in turn, integral with a radially outwardly extending annular flange 44. The flange 44 is provided with radial slots 45 therein at diametrically opposed locations (FIGS. 5 and 6). Extending axially through the body 41 are a pair of receptacle bores 46, which respectively have electrically conductive contact inserts 47 disposed therein adjacent to the flanged end of the body 41. The flanged end of the body 41 is provided with a circular recess 48 in the end surface thereof into which the contact inserts 47 project. The contact inserts 47 are respectively electrically connected by conductors 49 to the base member 31 in a known manner.

The socket 40 is received in a socket holder 50, which has a cylindrical side wall 51 closed at one end by an end wall 52 provided with a generally cruciform aperture 53 therein (FIGS. 2 and 6). The other end of the cylindrical side wall 51 is open, with a radially outwardly diverging frustoconical shoulder 54, which is in turn, integral at its distal end with a radially outwardly extending annular flange 55. The flange 55 is integral at its outer edge with a cylindrical wall 56 which projects therefrom in the same direction as the cylindrical side wall 51 coaxially therewith, the cylindrical wall 56 being integral at its distal end with a radially inwardly tapered, generally frustoconical short lip 57. Tabs 58 are struck from the flange 55 at diametrically opposed locations thereon. An annular wave spring 59 having an outer diameter greater than the inner diameter of the lip 57, is trapped between the flange 55 and the lip 57 in encircling relationship with the cylindrical side wall 51.

In assembly, the cylindrical portion 42 of the socket 40 is received in the open end of the cylindrical side wall 51 of the socket holder 50, until the flange 44 abuts the flange 55, as illustrated in FIGS. 2 and 3. In this position, the forward end of the socket 40 will be spaced a predetermined distance from the end wall 52 of the socket holder 50. The socket 40 is rotated until the slots 45 are aligned with the tabs 58, and the tabs 58 are bent downwardly through the slots 45 and upwardly against the underside of the flange 44 to retain the socket 40 in place. The cylindrical wall 56 of the socket holder 50 is dimensioned to be press-fitted telescopically within the cylindrical wall portion 34 of the base member 31. Alternatively, the socket holder 50 may be spot welded to the base member 31. The socket holder 50 is so dimension that, when the parts are thus assembled, the cylindrical side wall 51 will project forwardly well beyond the distal end of the cylindrical wall portion 36 of the base member 31. It will be appreciated that the wave spring 59 has a substantial width, so that it projects radially inwardly well beyond the edge of the lip 57.

Referring in particular to FIGS. 3 and 6, the bulb capsule 60 has a light-transmitting envelope 61, which may be formed of glass or other suitable material. The envelope 61 is generally cylindrical in shape, but is provided with a base end 62 which is generally cruciform in shape. Mounted within the envelope 61 is a filament 63, which is connected to a pair of wire terminal leads 65 which project from the base end 62. The bulb capsule 60 may contain gases including halogen gases, which may be under superatmospheric pressure.

In use, the base end 62 of the bulb capsule 60 is shaped and dimensioned to fit through the cruciform aperture 53 in the socket holder 50, for plugging the wire terminal leads 65 respectively into the socket receptacle bores 46, and into electrical contact with the contact inserts 47. When the bulb capsule 60 is thus mounted on the base assembly 30, the base assembly 30 may be, in turn, mounted on the globe 11. In this regard, the cylindrical wall portion 36 of the base member 31 is telescopically fitted over the mounting collar 20 in the manner described above, with the pins 22 being received in the J-shaped slots 37. It will be appreciated that, during this mounting movement, the bulb capsule 60 and the forward end of the socket holder 50 will be received through the hole 26 in the mounting collar 20 and the opening 16 in the globe 11 into the interior of the globe 11, as is best illustrated in FIG. 3.

The base assembly 30 is pushed onto the globe 11 until the pins 22 bottom out in the slots 37. As the base assembly 30 is moved to this position, the wave spring 59 will engage the flange 25 on the mounting collar 20 and be compressed thereby. The base assembly 30 is then rotated a slight distance about its axis to bring the pins 22 into alignment with the hook ends 37*a* of the slots 37. The wave spring 39 will then expand to resiliently hold the pins 22 in the hook ends 37*a*, so as to prevent accidental disengagement of the base assembly 30 from the globe 11. When the lamp 10 is engaged in an associated lamp receptacle and the receptacle is energized, the lamp 10 will emit light through the globe 11. In this regard, it will be appreciated that the bulb capsule 60 and the base assembly 30 are so dimensioned that, when the base assembly 30 is mounted in place on the globe 11, the bulb capsule 60 will be disposed in the optimum position to maximize light output, i.e., in the case of a reflectorized globe, at the focal point of the reflector.

When the bulb capsule 60 burns out, it can be replaced by simply removing the base assembly 30 from the globe 11. In this regard, the base assembly 30 is removed by compressing it slightly against the globe 11 to bring the pins 22 to the bottom of the slots 37, and then the base member 30 is rotated sufficiently to allow the pins 22 to be removed from the slots 37 so that the base member 30 can be moved axially to separate it from the globe 11.

In a constructional model of the invention, the mounting collar 20 may be formed of brass, the base member 30 may be formed of a suitable electrically conductive metal, the socket holder 50 may be formed of a nickel-plated steel, the wave spring 59 may be formed of stainless steel and the contact inserts 47 may be formed of a heat-resistant metallic material. It will be appreciated that the present invention may be utilized with either AC or DC lamps and, in the latter case, a suitable diode may be mounted in the base assembly 30.

From the foregoing, it can be seen that there has been provided an improved lamp with a removable base structure and a replaceable bulb capsule, which is of relatively simple and economical construction and is characterized by ease of use and assembly and long life.

I claim:

1. A lamp for use with a replaceable bulb capsule, comprising: a globe having a light transmitting front portion and a rear portion defining an opening thereinto, first mounting means discrete from said globe and mounted on said rear portion and including a hole aligned with said opening, and removable base structure including a socket constructed to removably receive the replaceable bulb capsule, said base structure including second mounting means for telescopically receiving said rear portion therein for engagement with said first mounting means in a mounted condition in which said socket and the replaceable bulb capsule received therein extend through said opening and said hole into said globe.

2. The lamp of claim 1, wherein said first mounting means comprises a cylindrical member encircling said rear portion of said globe, said second mounting means including a cylindrical portion of said base structure.

3. The lamp of claim 1, wherein said base structure includes an externally threaded portion.

4. The lamp of claim 1, wherein said globe includes a reflectorized portion.

5. The lamp of claim 4, wherein said reflectorized portion is frustoconical in shape.

6. The lamp of claim 1, wherein said globe is formed of glass.

7. A lamp for use with a replaceable bulb capsule, comprising: a globe having a light transmitting front portion and a rear portion defining an opening thereinto, mounting means on said rear portion including a hole aligned with said opening, removable base structure including a socket holder having a cylindrical side wall with opposed ends and an end wall closing said side wall at one end thereof with said side wall being open at the other end thereof, said end wall having an aperture therein, a socket received in said holder and through said open end aligned with said aperture to removably receive the replaceable bulb capsule through said aperture, means for retaining said socket in said holder, and means for retaining said removable base structure on said mounting means in a mounted condition in which said socket holder and the replaceable bulb capsule received in said socket extend through said opening and said hole into said globe.

8. The lamp of claim 7, wherein said socket includes a ceramic body having electrically conductive contact portions therein.

9. The lamp of claim 7, wherein said base structure includes a base member having a cylindrical wall discrete from said socket holder and fixed thereto.

10. The lamp of claim 9 wherein said socket holder includes an annular flange extending laterally outwardly therefrom and fixed to said cylindrical wall of said base member.

11. The lamp of claim 10, wherein said means for retaining said socket includes tabs struck from said flange and engageable with said socket.

12. A lamp for use with a replaceable bulb capsule, comprising: a globe having a light transmitting front portion and a rear portion defining an opening thereinto, mounting means on said rear portion including a hole aligned with said opening, removable base structure including a socket constructed to removably receive the replaceable bulb capsule, latch means accommodating movement of said base structure into a latched condition in latching engagement with said mounting means, and resilient bias means engageable with said mounting means and said base structure when said base structure is latched in its mounted condition for resiliently holding said latch means in the latched condition.

13. The lamp of claim 12, wherein said bias means includes an annular wave spring.

14. The lamp of claim 13, wherein said base structure includes an annular flange against which said spring is seated, and retaining means on said flange for retaining said spring thereon.

15. The lamp of claim 14 wherein said retaining means includes an upstanding cylindrical side wall with an annular inturned lip having an inner diameter less than the outer diameter of the wave spring.

16. The lamp of claim 14, wherein said base structure includes a base member and a socket holder discrete from said base member and receiving said socket therein, said flange being unitary with said socket holder and fixed to said base member.

17. The lamp of claim 14, wherein said mounting means includes an annular flange which cooperates with said annular flange on said base structure for compressing said wave spring therebetween when said base structure is latched in its mounted condition on said mounting means.

18. A lamp comprising: a globe having a light transmitting front portion and a rear portion defining an opening thereinto, first mounting means discrete from said globe and mounted on said rear portion and including a hole aligned with said opening, removable base structure including a socket, and a replaceable bulb capsule including a light-transmitting envelope and at least one wire terminal lead projecting therefrom for removable insertion directly in said socket, and said base structure including second mounting means telescopically receiving said rear portion therein for engagement with said first mounting means in a mounted condition in which said socket and said bulb capsule received in said socket extend through said opening and said hole into said globe.

19. The lamp of claim 18, wherein said socket includes two holes therein, said bulb capsule having two wire terminal leads respectively receivable in said socket holes.

20. The lamp of claim 18 wherein said capsule envelope is filled with gases under superatmospheric pressure.

* * * * *